US006813978B1

(12) United States Patent
Karpp

(10) Patent No.: US 6,813,978 B1
(45) Date of Patent: Nov. 9, 2004

(54) UNIVERSAL ADJUSTING TOOL

(76) Inventor: Lance D. Karpp, 3003 98th Ave. E., Parrish, FL (US) 34219

( * ) Notice: Subject to any disclaimer, the term of this patent is extended or adjusted under 35 U.S.C. 154(b) by 0 days.

(21) Appl. No.: 10/408,983

(22) Filed: Apr. 8, 2003

(51) Int. Cl.[7] ..... B25B 23/00; B25F 1/00
(52) U.S. Cl. ..... 81/437; 81/439; 81/176.15
(58) Field of Search ..... 81/436–439, 124.4, 81/125.1, 176.1, 176.15, 176.2

(56) References Cited

U.S. PATENT DOCUMENTS

| | | | | |
|---|---|---|---|---|
| 961,515 A | | 6/1910 | Montgomery | |
| 1,155,960 A | | 10/1915 | Ruth | |
| 2,735,325 A | * | 2/1956 | Rudd, Sr. | 81/439 |
| 2,923,312 A | | 2/1960 | Wagner | |
| 4,448,097 A | * | 5/1984 | Rocca | 81/439 |
| 5,140,877 A | | 8/1992 | Sloan | |
| 5,186,083 A | * | 2/1993 | Hsiao | 81/124.4 |

* cited by examiner

*Primary Examiner*—Debra S. Meislin
(74) *Attorney, Agent, or Firm*—Charles J. Prescott

(57) ABSTRACT

A universal gas pressure adjustment tool for a plurality of gas pressure regulators each of which is connected in line with a pressurized natural gas supply conduit and having a pressure adjusting member which adjustably controls the outlet gas pressure of gas exiting from the regulator. Each of the adjusting members within each regulator have a different structure for engagement with, and rotatable moveable by, a particular different adjustment tool drive end configured for engagement with the particular adjusting member to effect regulation of the gas outlet pressure. The adjustment tool has an elongated body having a plurality of different end configurations, each of which is structured for mating substantially coaxial alignment and engagement with, and for axial rotatable adjustment of, a particular adjusting member. Each of the end configurations is readily accessible for use with one particular corresponding adjusting member without interference from any of the other end configurations.

1 Claim, 2 Drawing Sheets

UNIVERSAL ADJUSTING TOOL

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to natural gas pressure regulators, and more particularly to a universal adjustment tool for varying the gas outlet pressure exiting therefrom during installation and routine service.

2. Description of Related Art

The primary function of a natural gas pressure regulator is to reduce high-pressure gas in a cylinder or conduit delivery line to a lower, usable level as it passes into equipment for use. Inlet gas pressure may range from 10–60 psi while gas outlet pressure is very low in the range of about ¼ psi. Within each such regulator, which is used to control delivery pressure only, are three basic operating components: a loading mechanism, a sensing element, and a control element working together to effect proper outlet pressure regulation.

The loading mechanism concerns the setting of the regulator delivery pressure, typically in the form of a coil spring acting in compression. An adjusting member is threadably engagable within the housing of the regulator to vary the spring pressure and force exerted upon the control element and the sensing element, typically in the form of a diaphragm, to achieve a desired outlet pressure.

Each manufacturer of residential natural gas pressure regulators seems to have adopted its own size and configuration for engagement with the adjusting member which is typically concealed within the regulator and accessible by a removal of a protective cap. Some of the adjusting members thus are adjustably driven by a particularly sized hexagonal male drive member, while others are mechanically engagable within a hexagonal female drive cavity of an adjusting tool. Still other adjusting members are provided with opposing slots extending radially from an elongated central aperture through which a relief shaft extends in variable length depending upon the pressure setting of the regulator.

The range of different configurations of the drive or engagement portion of the adjusting member of a variety of residential gas pressure regulators by different manufacturers which have been encountered by applicant is his business or profession are shown in Table I below.

TABLE I

| Manufacturer | Model | Pressure Adjusting Drive Configuration |
|---|---|---|
| Schlumberger | B-42 & 31-R | Opposing spaces slots |
| American | 1813 C | ⅜" Male Hex |

TABLE I-continued

| Manufacturer | Model | Pressure Adjusting Drive Configuration |
|---|---|---|
| Equimeter | 043 & 143 | 7/16" female hex |
| Equimeter | 143 HP | ½" female hex |
| American | 1213B & B2 | 9/16" female hex |
| Lancaster | 61 | ⅝" female hex |
| Fisher | R-522 | ½" female hex |

As should be dear from Table I, a professional service person dealing with residential gas pressure regulators must therefore have a broad range of individual adjusting tools in order to be prepared to adjust the pressure of any particular gas pressure regulator which is encountered in field service. In lieu of having a proper tool, many service technicians will simply use a flat-bladed screw driver which runs the risk of damaging the adjusting member as it is typically made from plastic material and the like.

The present invention provides a universal adjustment tool which is configured to properly engage with a substantial number, if not all, of the gas pressure adjusting members of residential gas pressure regulators currently in service in the field. Thus, a service technician or professional, by carrying the present invention, will be readily able to quickly effect the internal adjustment of the adjusting member in regulating and properly resetting the gas pressure outlet of each regulator serviced.

BRIEF SUMMARY OF THE INVENTION

This invention is directed to a universal gas pressure adjustment tool for a plurality of gas pressure regulators each of which is connected in line with a pressurized natural gas supply conduit and having a pressure adjusting member which adjustably controls the outlet gas pressure of gas exiting from the regulator. Each of the adjusting members within each regulator have a different structure for engagement with, and rotatable moveable by, a particular different adjustment tool drive end configured for engagement with the particular adjusting member to effect regulation of the gas outlet pressure. The adjustment tool has an elongated body having a plurality of different end configurations, each of which is structured for mating substantially coaxial alignment and engagement with, and for axial rotatable adjustment of, a particular adjusting member. Each of the end configurations is readily accessible for use with one particular corresponding adjusting member without interference from any of the other end configurations.

It is therefore an object of this invention to provide a universal adjustment tool for adjusting the outlet gas pressure of a gas pressure regulator.

Still another object of this invention is to provide a universal adjustment tool for the adjustment of outlet gas pressure in a broad range of gas pressure regulators each of which have a differently configured adjusting member.

Yet another object of this invention is to provide a single adjustment tool which will deal with virtually all of the differently configured adjusting members of gas pressure regulators now deployed in the field.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
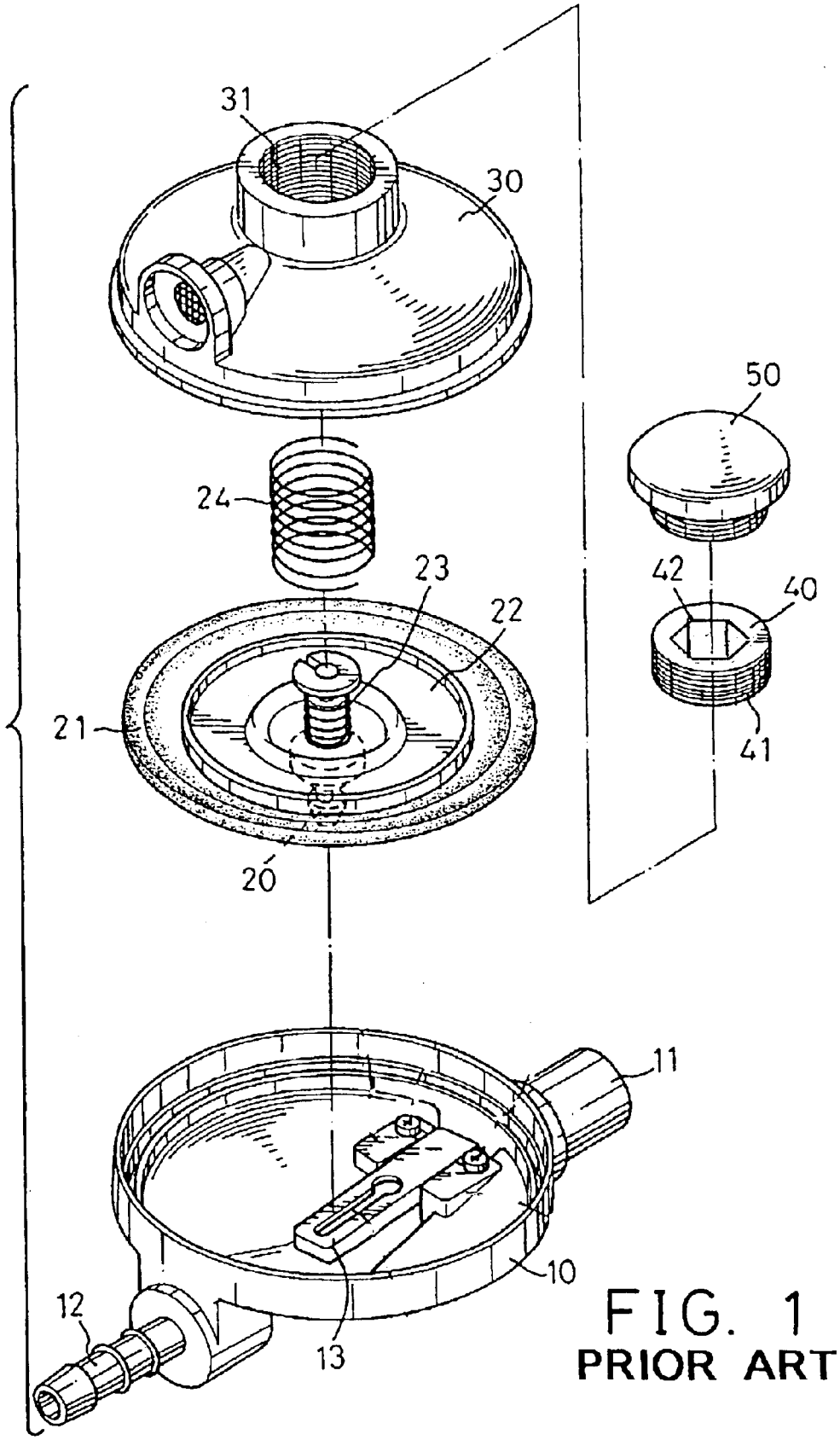
FIG. 1 PRIOR ART
FIG. 1 is an exploded perspective view of a typical prior art residential gas pressure regulator.

Referring now to the drawings, and particularly to FIG. 1, a typical prior art gas pressure regulator for residential use is there shown which includes a body 10 having a gas inlet 11 and a gas outlet 12 in communication with the interior thereof.

In the body 10, a control lever 13 is provided having a first and second end thereof. The control lever 13 is structured, supported and operated as disclosed in U.S. Pat. No. 6,505,640, the entire body of which is incorporated herein by reference. The lifting rod 20 has a flange that tightly abuts the diaphragm 21 by an inner spring 23 compressed between a metal disc 22 atop the diaphragm 21 and a C-shaped collar retained at the bottom end of the lifting rod 20.

The hollow body 10 is covered by a bonnet 30 that defines a threaded hole 31 positioned centrally and coaxially therewith. A pressure adjusting member 40 having a threaded periphery 41 and a female hex drive cavity 42 is received in and is threadably engaged with the hole 31 to adjustably press upon an outer spring 24 against the metal disc 22, thereby changing the gas pressure at which the diaphragm 21 is so convex that the lifting rod 20 pivots the control lever 13 to the closed position. Preferably, a cap 50 is threadably engaged into the threaded hole 31 of the bonnet 30 to shield the pressure-adjusting member 40.

The Invention

Figure 3:
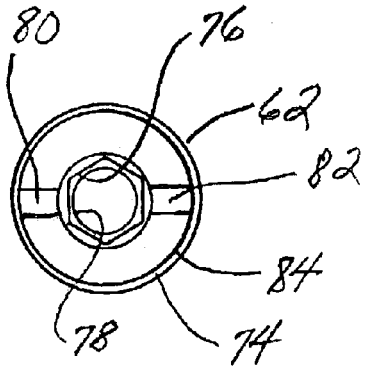
FIG. 3 is an end view in the direction of arrows 3—3 in FIG. 2.
Figure 2:
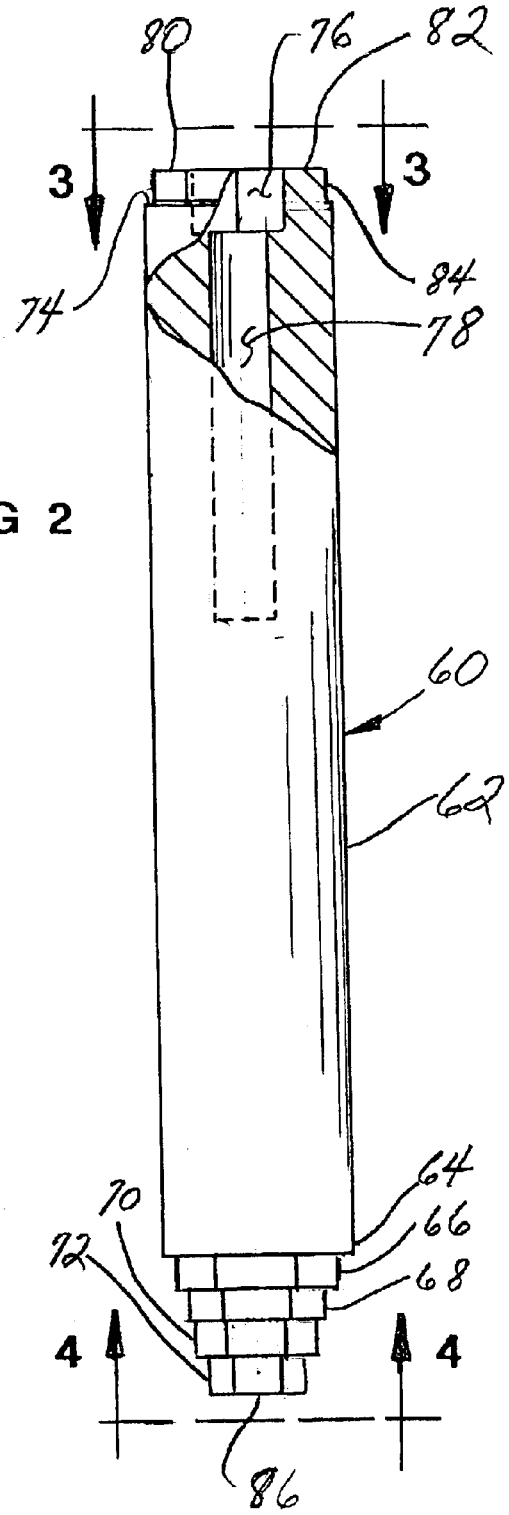
FIG. 2 is a side elevation broken view of the invention.
Figure 4:
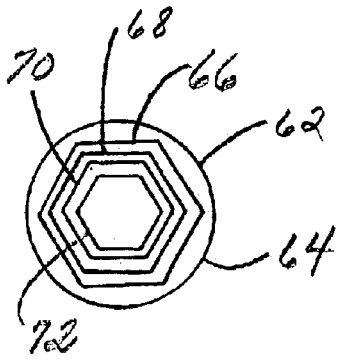
FIG. 4 is an end view in the direction of arrows 4—4 in FIG. 2.

Referring now to FIGS. 2 to 4, the invention is there shown generally at numeral 60 and includes an elongated cylindrical straight shaft 62 having a medium pitch diamond knurled surface and first and second ends shown in detail in FIGS. 3 and 4, respectively. Construction may take the form of a CNC-machined part or be die cast of plastic. The first end shown in FIG. 3 is structured to adjustably engage two separate, distinctive configurations of adjusting member end configurations. The first of those configurations to which the universal adjustment tool 60 will adjustably engage is that of a male hex drive of the exposed or accessible end of a comparably configured adjusting member. The typical size of the hex cavity 76 formed coaxially into the first end of the elongated body 62 is a ⅜" male hex configuration requiring a corresponding ⅜" female hex cavity 76. Referring back to Table I, a typical gas pressure regulator supplied by American, Model 1813C, would require such a size and configuration to effect adjustment of that adjusting member.

Another end configuration in the form of spaced apart radially extending tabs 80 and 82 is also provided. Again, referring to Table I, a Schlumberger Model B42R and B-31R would require this configuration of adjusting member drive configuration to effect adjustment of that particular gas pressure regulator. Note that a separate peripheral cut at 84 may be required to fit into the threads of the housing into which this adjusting member is mounted.

As is typically found with respect to the internal components of the Schlumberger gas pressure regulators, an elongated relief shaft extends axially from an aperture formed into the end of the adjusting member contained in this regulator. To accommodate the extension of such a relief shaft (not shown) while effecting gas pressure adjustment, an elongated central cavity 78 which extends from the female hex drive cavity 76 is also provided so that the full smooth operation of the gas relief valve during its adjustment is uninhibited to achieve proper outlet pressure setting.

The second end of the device 60 as best seen in FIGS. 2 and 4, provides a series of stepped down in size male hexagonal end configurations at 66, 68, 70 and 72, respectively. These hexagonal configurations 66, 68, 70 and 72, which are coaxial and stepwise smaller toward the distal second end 86, are sized to be standard male hexagonal drives sized as ⅝", 9⁄16", ½", and 7⁄16". Referring back to Table I, the examples of commercially available gas pressure regulators having these hexagonal drive sizes are there shown.

Based upon the foregoing, it should be clear now that, by providing a single universal tool 60, having distinctive first and second end configurations as above described, virtually all residential gas pressure regulators, both old and new, may be adjusted with this single universal adjustment tool 60. The time savings and convenience provided by the present invention to a technician and professional in accomplishing this pressure adjustment procedure required each time such a system is serviced, is both substantial and perhaps immeasurable. Moreover, absent the availability of the present tool, the use of non-compliant or non-mating tool devices such as screwdrivers could easily damage the adjusting member or diaphragm which, in worse case scenario, could require replacement of the entire gas pressure regulator itself.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. For a plurality of gas pressure regulators each of which is connected in line with a pressurized natural gas supply conduit and having a pressure adjusting member which adjustably controls the outlet gas pressure exiting from the regulator, each adjusting member of the plurality of regulators having a different structure engagable with and rotatably moveable by a particular adjustment tool configured for engagement with the particular adjusting member to effect regulation of the outlet pressure, a universal adjustment tool comprising:

an elongated straight body having a plurality of different end configurations each of which is structured for mating substantially coaxial alignment and engagement with, and for axial rotatable adjustment of, a particular adjusting member;

each of said plurality of end configurations being readily accessible for use with one particular corresponding adjusting member without interference from the other said end configurations;

a portion of the plurality of end configurations including at least two differently sized configurations concentric hexagonal drive surfaces stepped down in size toward one end of said body;

another portion of the plurality of said end configurations disposed at the other end of said body include a hexagonal drive cavity and two radially extending opposing drive tabs.

* * * * *